US010588407B2

(12) United States Patent
Held

(10) Patent No.: US 10,588,407 B2
(45) Date of Patent: Mar. 17, 2020

(54) WALL CABINET, IN PARTICULAR A KITCHEN WALL CABINET

(71) Applicant: FORM ORANGE PRODUKTENTWICKLUNG, Hard (AT)

(72) Inventor: Wolfgang Held, Hard (AT)

(73) Assignee: FORM ORANGE PRODUKTENTWICKLUNG, Hard (AT)

( * ) Notice: Subject to any disclaimer, the term of this patent is extended or adjusted under 35 U.S.C. 154(b) by 47 days.

(21) Appl. No.: 15/756,540

(22) PCT Filed: Aug. 11, 2016

(86) PCT No.: PCT/EP2016/069176

§ 371 (c)(1),
(2) Date: Feb. 28, 2018

(87) PCT Pub. No.: WO2017/029199

PCT Pub. Date: Feb. 23, 2017

(65) Prior Publication Data

US 2019/0166992 A1 Jun. 6, 2019

(30) Foreign Application Priority Data

Aug. 14, 2015 (DE) ..... 10 2015 113 427

(51) Int. Cl.
*A47B 96/00* (2006.01)
*E05F 1/10* (2006.01)
(Continued)

(52) U.S. Cl.
CPC ..... *A47B 77/022* (2013.01); *A47B 77/00* (2013.01); *A47B 77/08* (2013.01); *A47B 77/14* (2013.01);
(Continued)

(58) Field of Classification Search
CPC ..... E05D 15/262; E05D 15/46; E05F 1/1058; A47B 77/022; A47B 77/00; A47B 77/08; A47B 77/14
See application file for complete search history.

(56) References Cited

U.S. PATENT DOCUMENTS 2,886,394 A * 5/1959 Snyder ..... E06B 3/482 126/340
8,696,076 B2 * 4/2014 Karg ..... E05D 15/262 312/323
(Continued)

FOREIGN PATENT DOCUMENTS

WO WO2005/075781 A2 8/2005
WO WO-2018158151 A2 * 9/2018 ..... A47B 96/201

*Primary Examiner* — Kimberley S Wright
(74) *Attorney, Agent, or Firm* — John Alumit

(57) ABSTRACT

The invention relates to a wall-mounted cabinet having a block-shaped cabinet carcass, the open front side of which can be closed with at least one cabinet door that is hinged to the cabinet carcass and is flush with the outer sides of the vertical side walls and of the horizontal top wall of the cabinet carcass in the closed position of the cabinet door, in particular a wall-mounted kitchen cabinet. In order for the wall-mounted cabinet to have at least one cabinet box, which regardless of whether the cabinet door is open or closed is always accessible for putting pots and pans, kitchen utensils, and the like in it and storing them, the invention provides that tilt fittings for a cabinet door embodied as a flap door are mounted on the inner sides of the side walls in the upper region of the cabinet carcass; that the tilt fittings are covered by inner walls; that the flap door is composed of an inner panel and an outer panel, which extends across an upper front region of the cabinet carcass from the outside of the top wall of the cabinet carcass to the top side of the lower cabinet box and with which the lowerable front coverings between the inner walls and the side walls of the cabinet
(Continued)

carcass are associated; that the outer panel of the flap door extends at least across a lower region of the front side of the inner panel and extends as far as the top side of the lowermost cabinet box of the cabinet carcass; and that fixed front coverings, adjacent to lowerable front coverings, extend to the underside of the lowermost cabinet box of the cabinet carcass between the inner walls and the side walls of the cabinet carcass and are flush with the ends of the inner walls and of the side walls of the cabinet carcass.

10 Claims, 13 Drawing Sheets

(51) Int. Cl.

| | |
|---|---|
| ***A47B 77/02*** | (2006.01) |
| ***A47B 77/00*** | (2006.01) |
| ***E05D 15/46*** | (2006.01) |
| ***A47B 77/08*** | (2006.01) |
| ***A47B 77/14*** | (2006.01) |
| ***A47B 95/00*** | (2006.01) |
| ***E05D 13/00*** | (2006.01) |

(52) U.S. Cl.
CPC ..... *A47B 95/008* (2013.01); *E05D 13/00* (2013.01); *E05D 15/463* (2013.01); *A47B 2220/0077* (2013.01); *E05Y 2201/11* (2013.01); *E05Y 2900/20* (2013.01)

(56) References Cited

U.S. PATENT DOCUMENTS

| | | | | |
|---|---|---|---|---|
| 9,518,418 | B2 * | 12/2016 | Cappellotto | E05F 17/004 |
| 2010/0270438 | A1 * | 10/2010 | Pandorf | A47B 67/02 248/65 |
| 2011/0036015 | A1 * | 2/2011 | Archer | E05D 15/262 49/197 |
| 2013/0334944 | A1 * | 12/2013 | Karg | E05D 15/262 312/237 |
| 2015/0218873 | A1 * | 8/2015 | Cappellotto | E05F 17/004 49/102 |

* cited by examiner

WALL CABINET, IN PARTICULAR A KITCHEN WALL CABINET

The invention relates to a wall-mounted cabinet having a block-shaped cabinet carcass, the open end of which is closable with at least one cabinet door, which is pivotably connected to the cabinet carcass.

Wall-mounted cabinets, in particular wall-mounted kitchen cabinets, are known in which the cabinet carcass is divided up into three or more cabinet boxes one above the other. The cabinet box has at least one cabinet door pivotably connected via a vertical pivot shaft. Only when the cabinet door is in the open position are the cabinet boxes accessible for putting pots and pans, kitchen utensils, and the like into them or storing them.

However, wall-mounted shelves without a cabinet door are also known, in which the cubbyholes are always accessible so that pots and pans, kitchen utensils, and the like can always be put in them or stored there.

It is the object of the invention to create a wall-mounted cabinet, in particular a wall-mounted kitchen cabinet, in which at least one cabinet box is always accessible regardless of the open or closed position of the cabinet door, while other cabinet boxes are accessible only in the open position of the cabinet door, and can be used for putting pots and pans, kitchen utensils, and the like in them or storing them there.

This object is attained by the features of claim 1.

This is attained in that tilt fittings for a cabinet door embodied as a flap door are mounted on the inner sides of the side walls in the upper region of the cabinet carcass; that the tilt fittings are covered by inner walls; that the flap door is composed of an inner panel and an outer panel, which extends across an upper front region of the cabinet carcass from the outside of the top wall of the cabinet carcass to the top side of the lower cabinet box and with which the lowerable front coverings between the inner walls and the side walls of the cabinet carcass are associated; that the outer panel of the flap door extends at least across a lower region of the front side of the inner panel and extends as far as the top side of the lowermost cabinet box of the cabinet carcass; that fixed front coverings, adjacent to lowerable front coverings, extend to the underside of the lowermost cabinet box of the cabinet carcass between the inner walls and the side walls of the cabinet carcass and are flush with the ends of the inner walls and of the side walls of the cabinet carcass.

In this way, regardless of the open and closed position of the flap door, the front side of the lowermost cabinet box is always open and accessible for putting pots and pans, kitchen utensils, and the like in them or storing them there. The other cabinet boxes of the wall-mounted cabinet located below it can be closed and opened with the flap door. The front coverings, which can be lowered, ensure that the wall-mounted cabinet is incorporated flush with a row of cubicles in the closed position of the flap door. The front coverings that are fixed and adjoin the lowerable front coverings on the underside of the cabinet carcass ensure a clean closure of the interstices between the inner walls and the side walls of the cabinet carcass. The outer panel of the flap door, protruding from the cubicles in the line of cubicles, can easily be grasped and opened.

Advantageous embodiments of the wall-mounted cabinet can be learned from the dependent claims.

The tilt fittings are secured tiltably on the ends of boards; the open position of the flap door is fixed by means of catches of the boards and of the tilt fittings, and the tilt fittings in the closed position of the flap door are closed flush into the interstices of the inner walls and the side walls of the cabinet carcass. The fastening face, for the inner panel of the flap door, forms the connection for the flap door.

The lowerable front coverings, in the open position of the flap door, protrude past the ends of the inner walls and side walls of the cabinet carcass. In the closed position of the flap door, the lowerable front coverings are pressed into the interstices between the inner walls and the side walls of the cabinet carcass and are flush with them.

The wall-mounted cabinet preferably has three cabinet boxes located vertically one above the other. The flap door, in the closed position, closes the top two cabinet boxes of the cabinet carcass.

In a further feature, the interior of the cabinet carcass can also support both lighting elements, on the inner sides of the inner walls in the upper region of the cabinet carcass, and elements for electrification, preferably embodied as bores for receiving electrical outlets and the like, in the lower region of the cabinet carcass.

Subdividing the cabinet carcass into cabinet boxes can be accomplished by means of sheet-metal elements, which are preferably embodied as an organization system.

The wall-mounted cabinet of the invention can be built flush into a row of cubicles, and the outer panel of the flap door, in the closed position, protrudes from the front side of the row of cubicles by a distance equivalent to the thickness of the inner panel of the flap door. Thus the ease of grasping the flap door on opening the flap door is preserved.

Below the row of cubicles, at a spacing, a horizontal work surface can be located, which covers a substructure of lower cubicles.

The invention will be described in further detail in terms of the exemplary embodiment shown in the accompanying drawings. In the drawings:

FIG. 1 in perspective shows a block-shaped cabinet carcass, with tilt fittings for a flap door that are secured to the inner sides of the vertical side walls of the cabinet carcass, in the upper region of the cabinet carcass;

Figure 2:
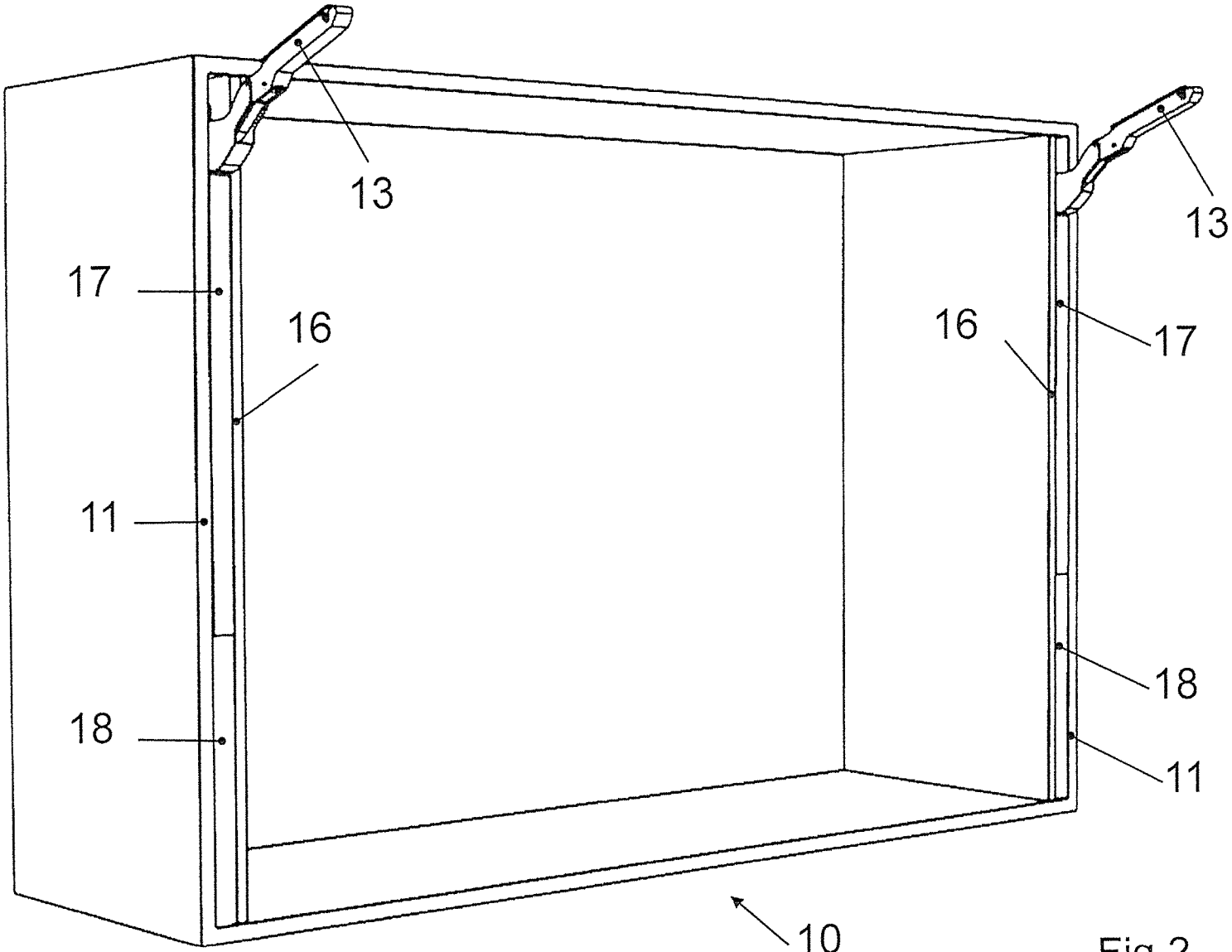
FIG. 2 shows the cabinet carcass of FIG. 1, in which the tilt fittings are covered by vertical inner walls, and the interstices between the inner walls and the side walls of the cabinet carcass are closed, in the upper region of the cabinet carcass, by lowerable front coverings and, in the lower region of the cabinet carcass, by fixed front coverings.
Figure 4:
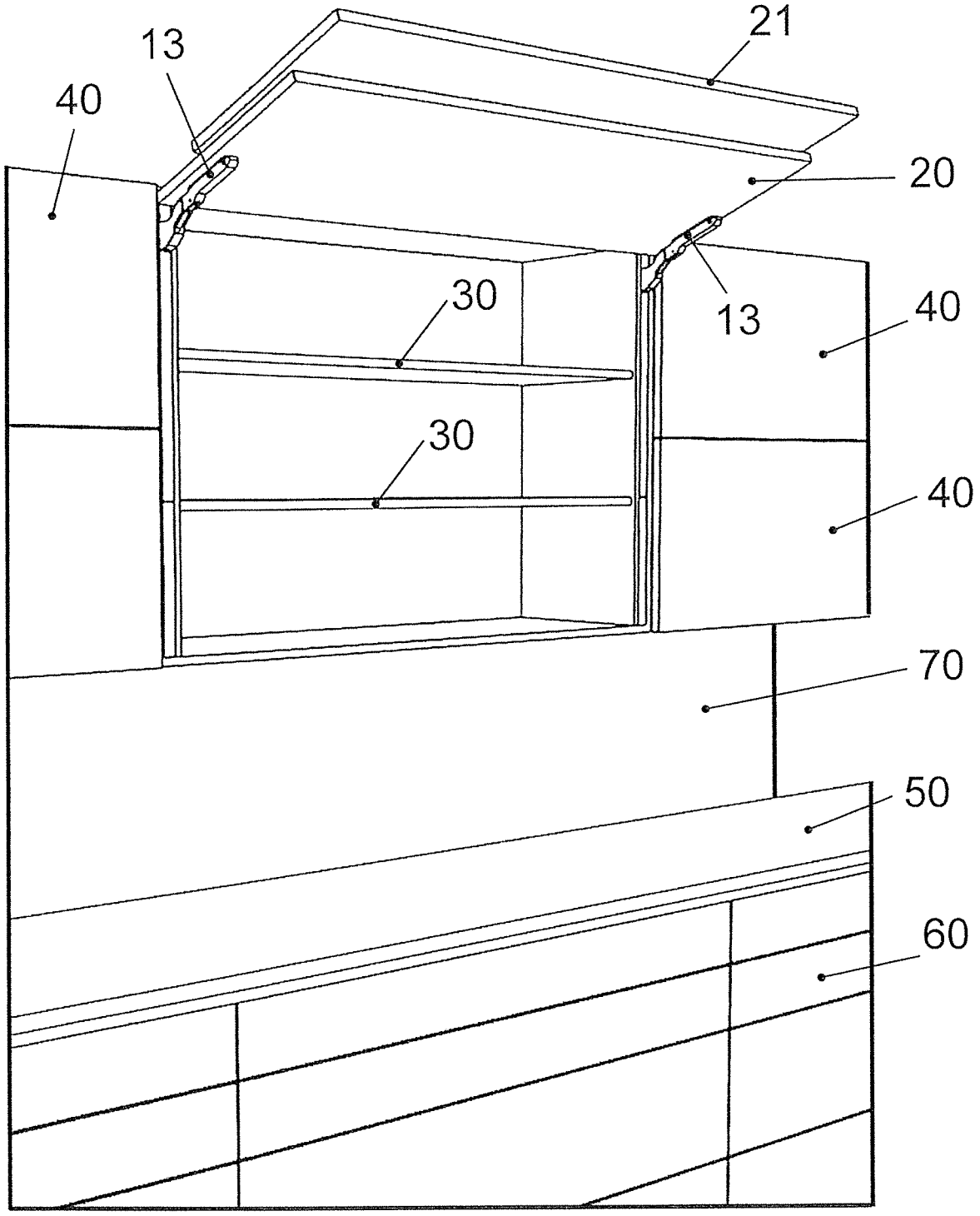
Figure 5:
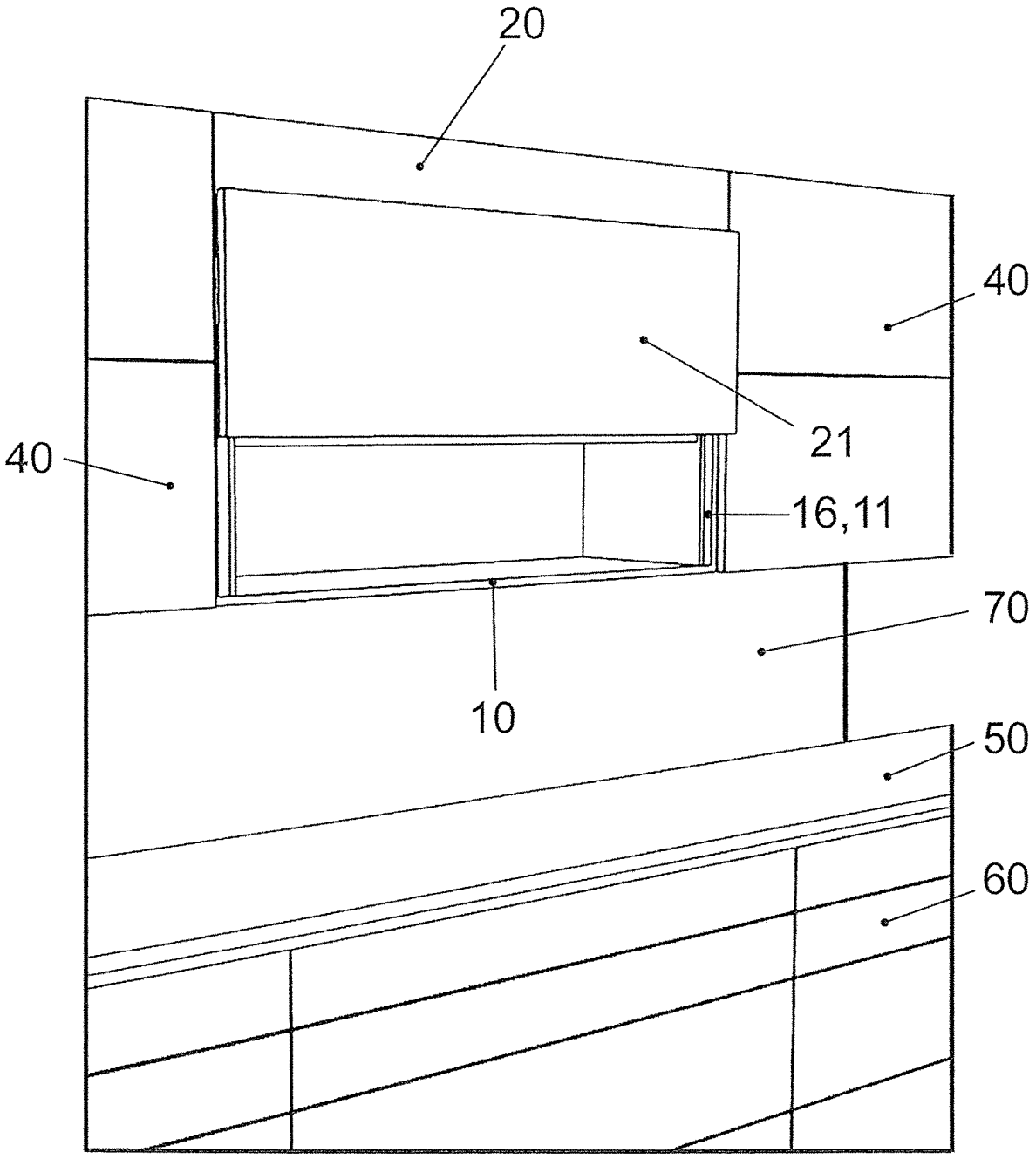
Figure 6:
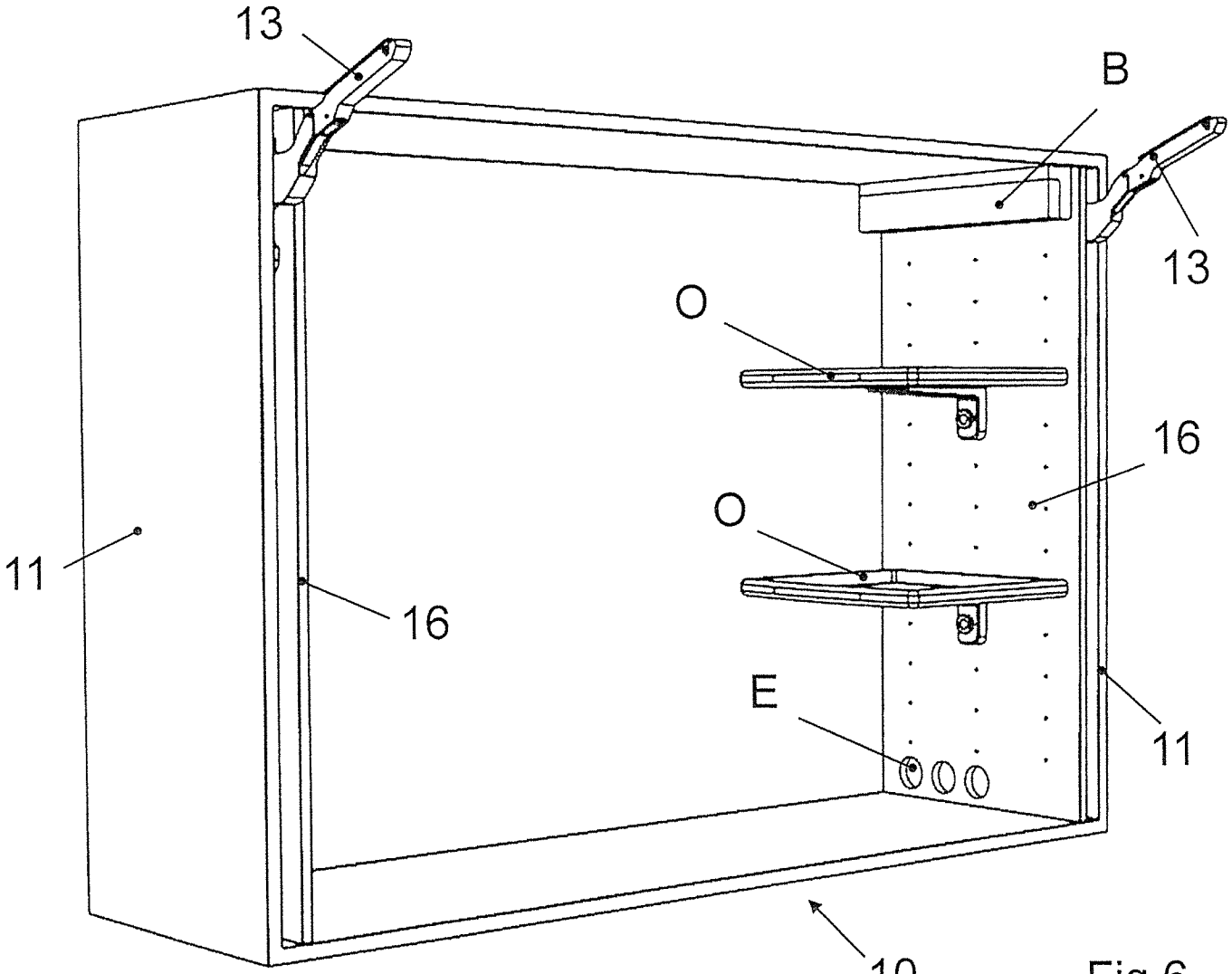
Figure 7:
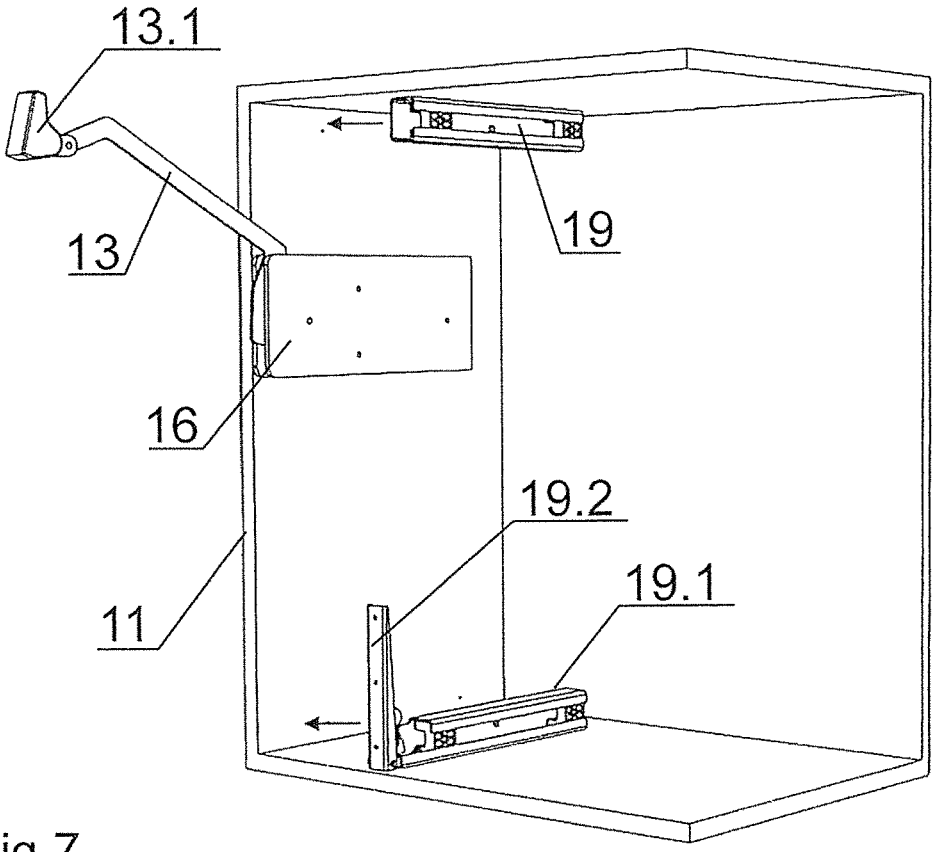
Figure 8:
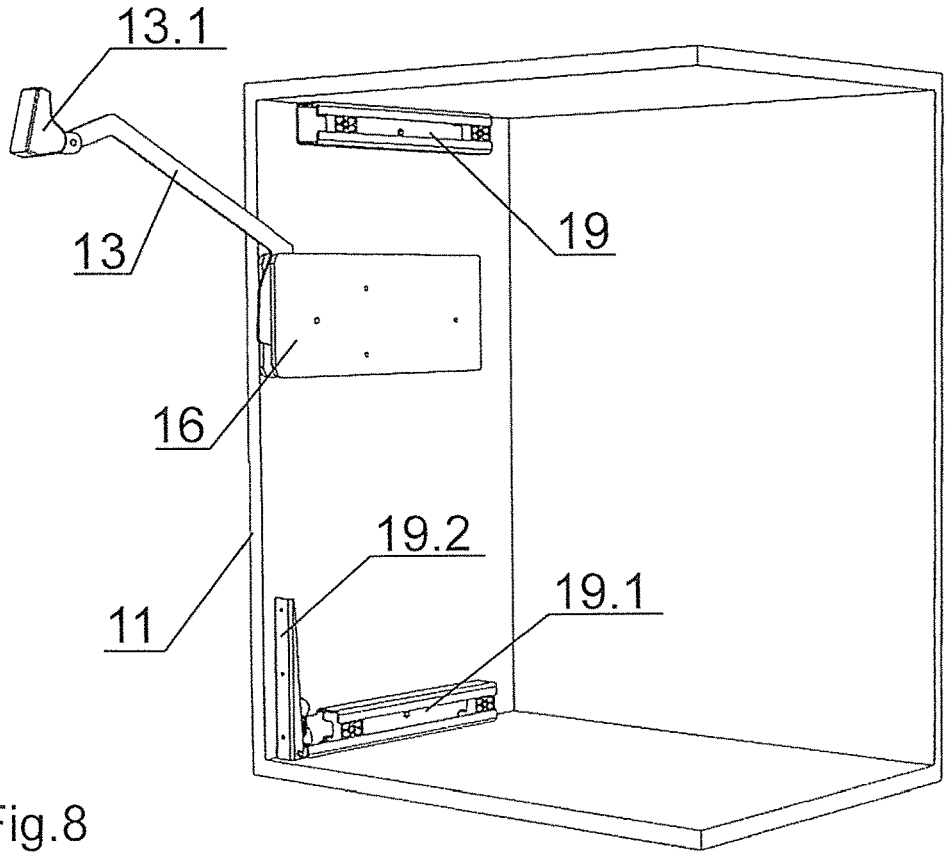
Figure 9:
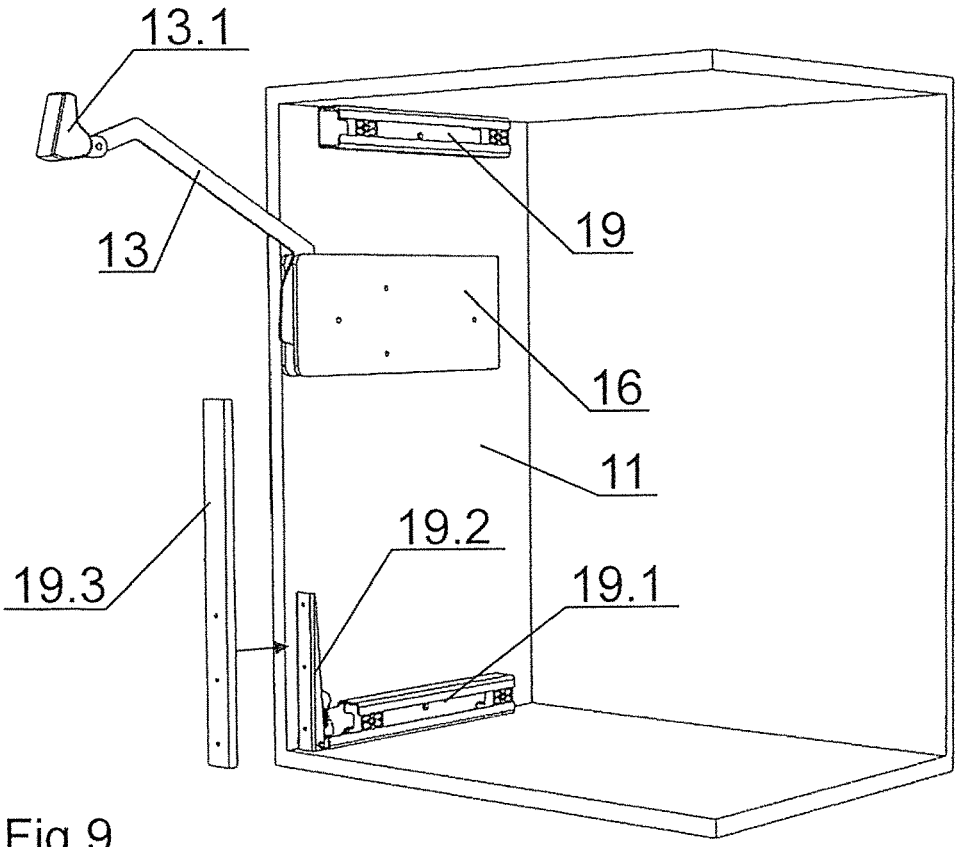
Figure 10:
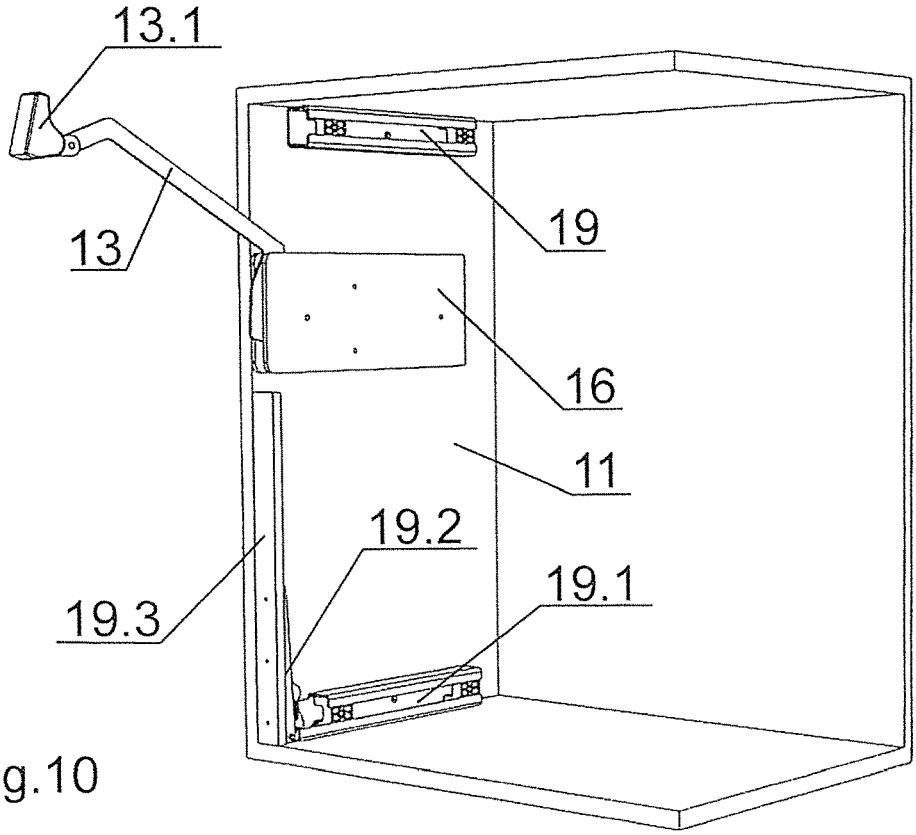
Figure 11:
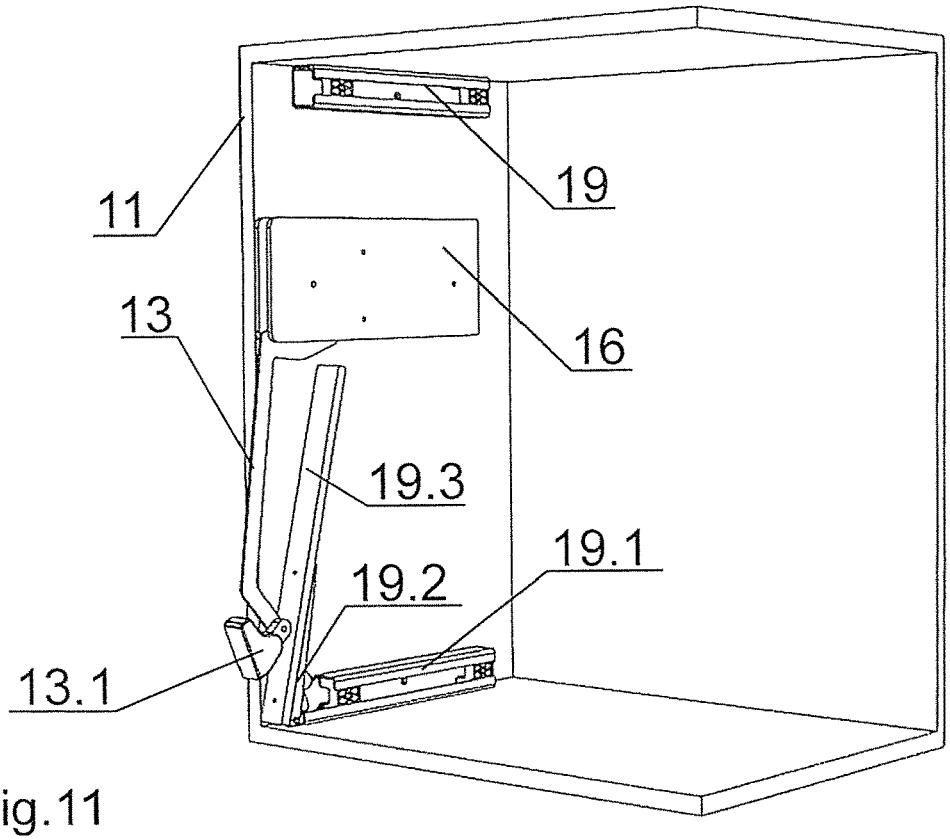
Figure 12:
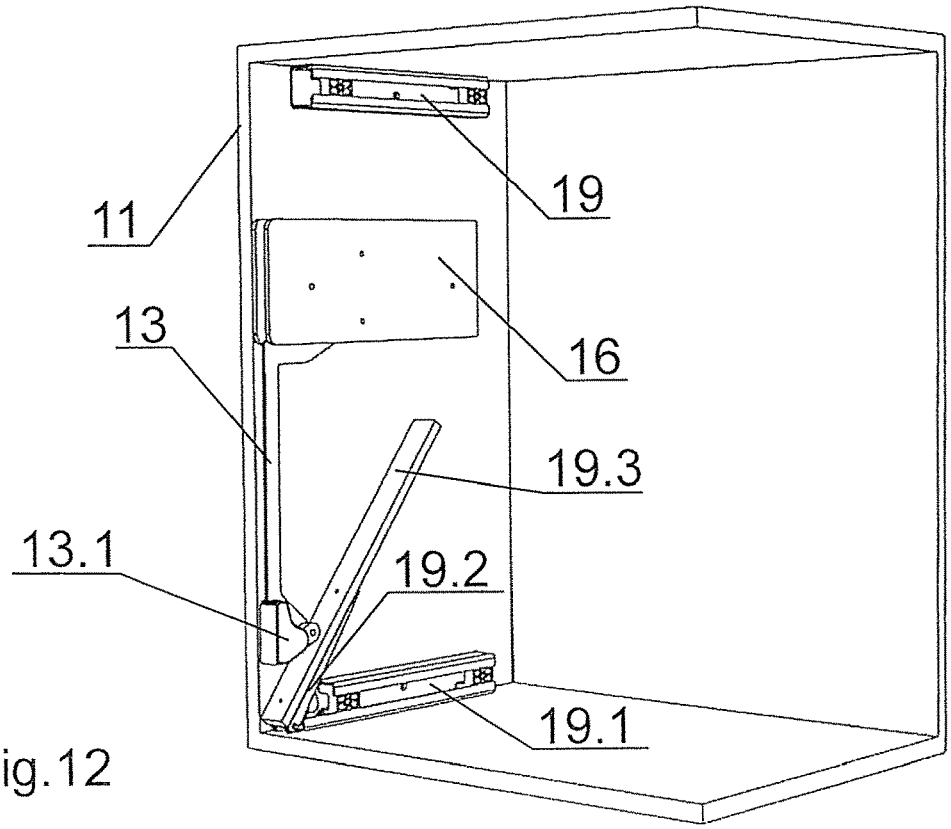
Figure 13:
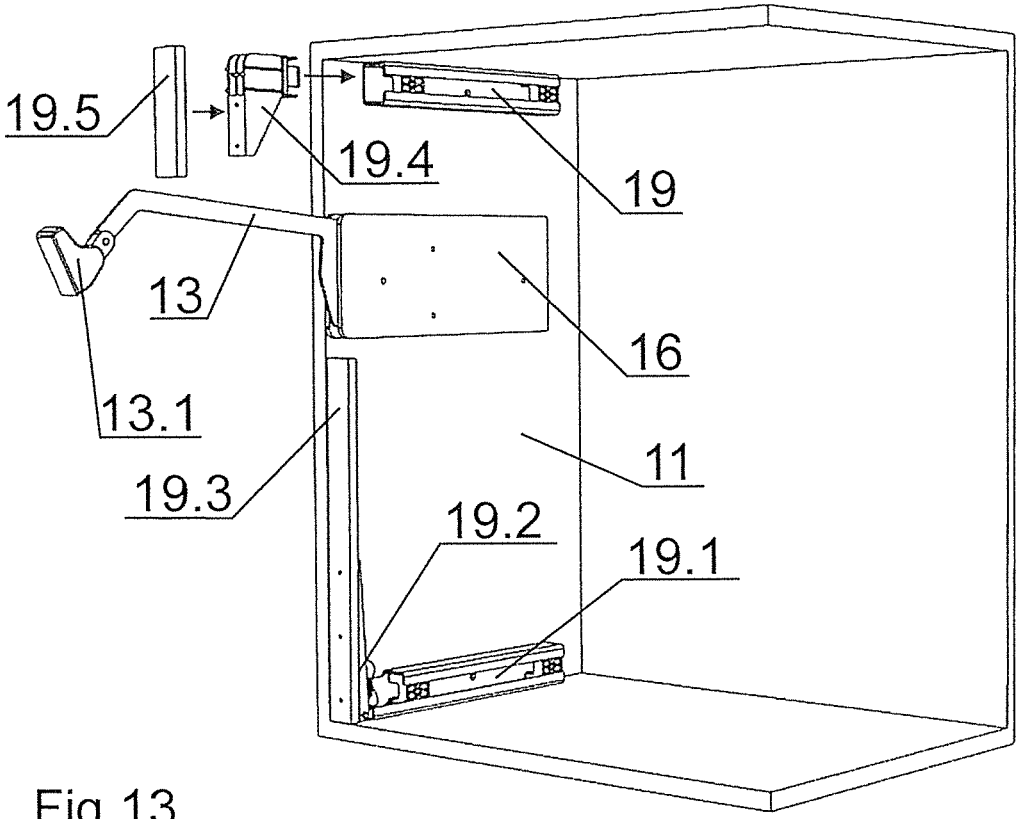
Figure 14:
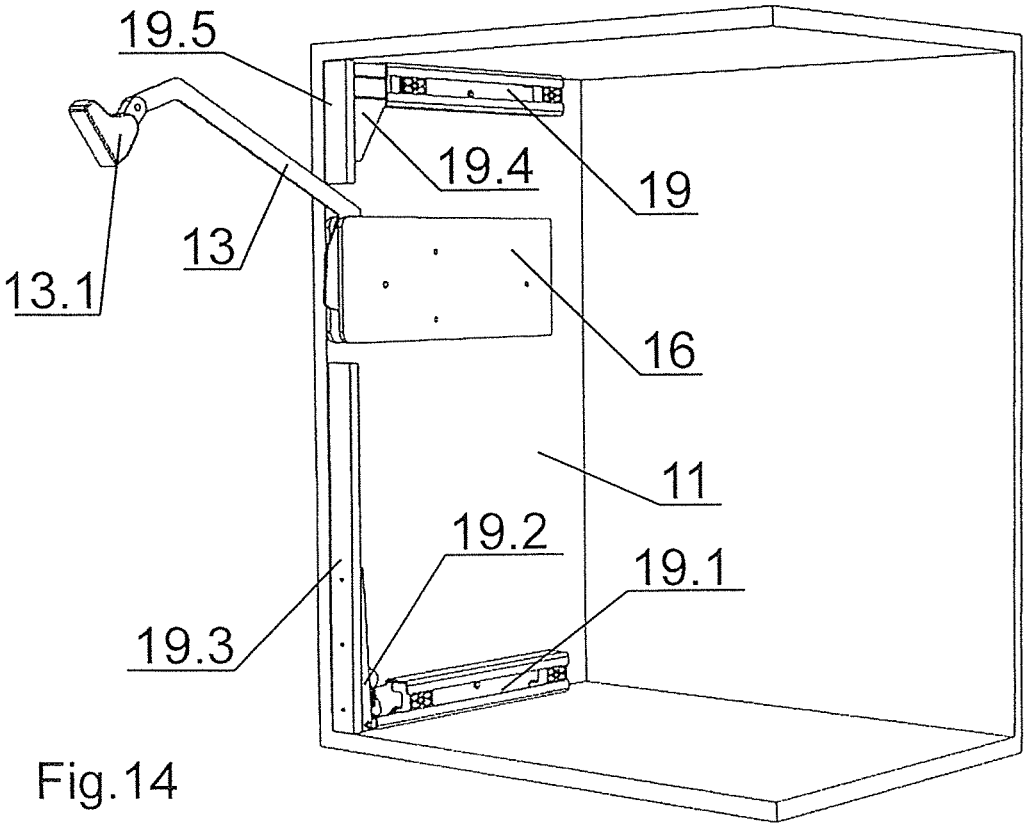
Figure 15:
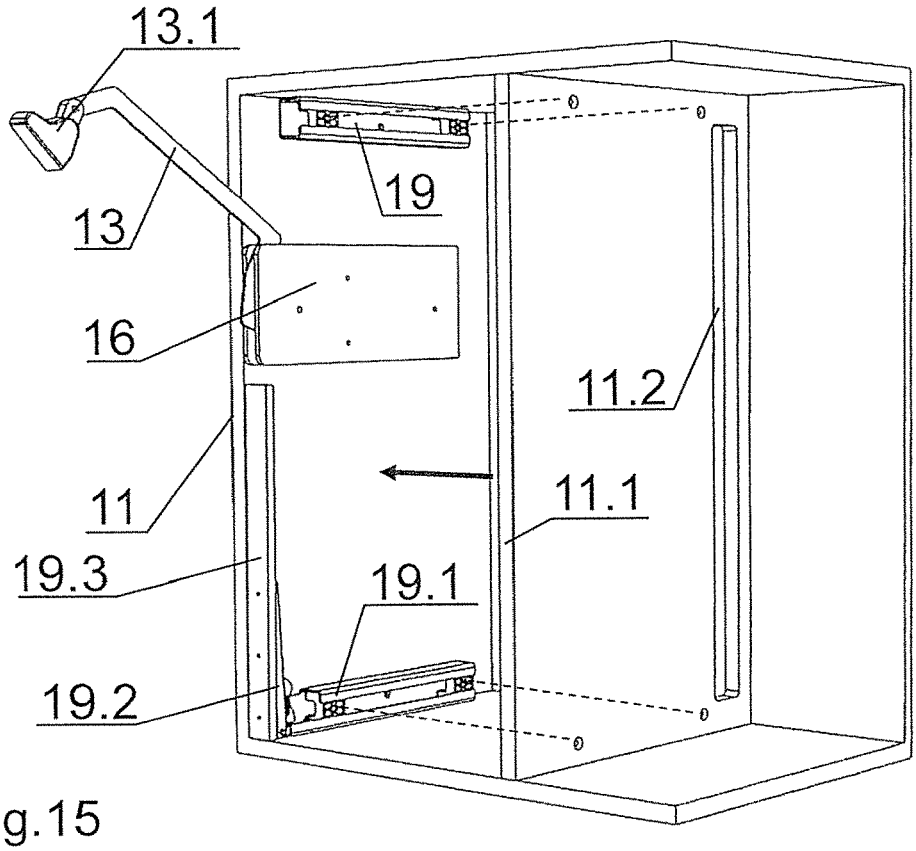
Figure 16:
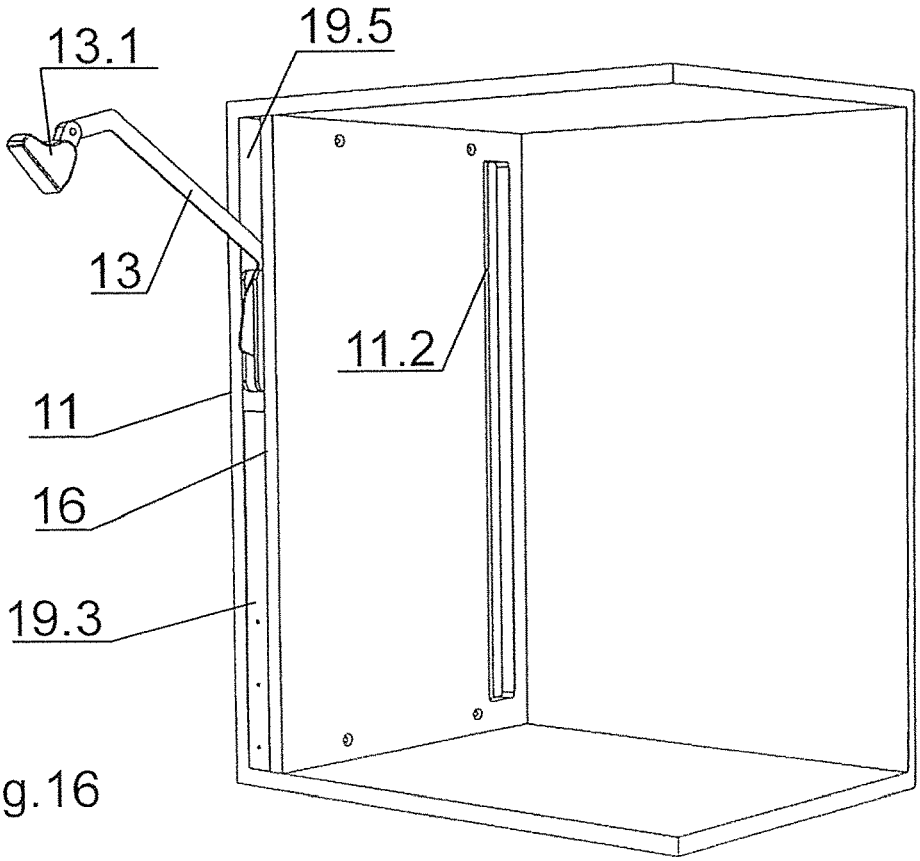
Figure 17:
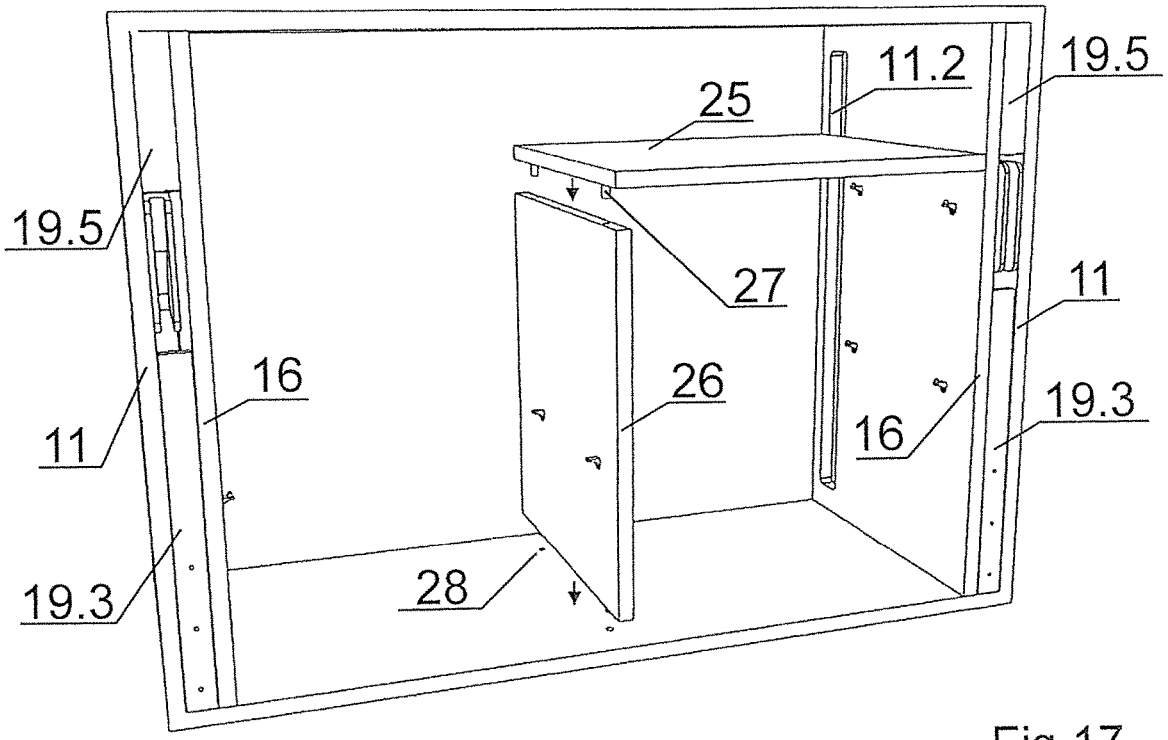
Figure 18:
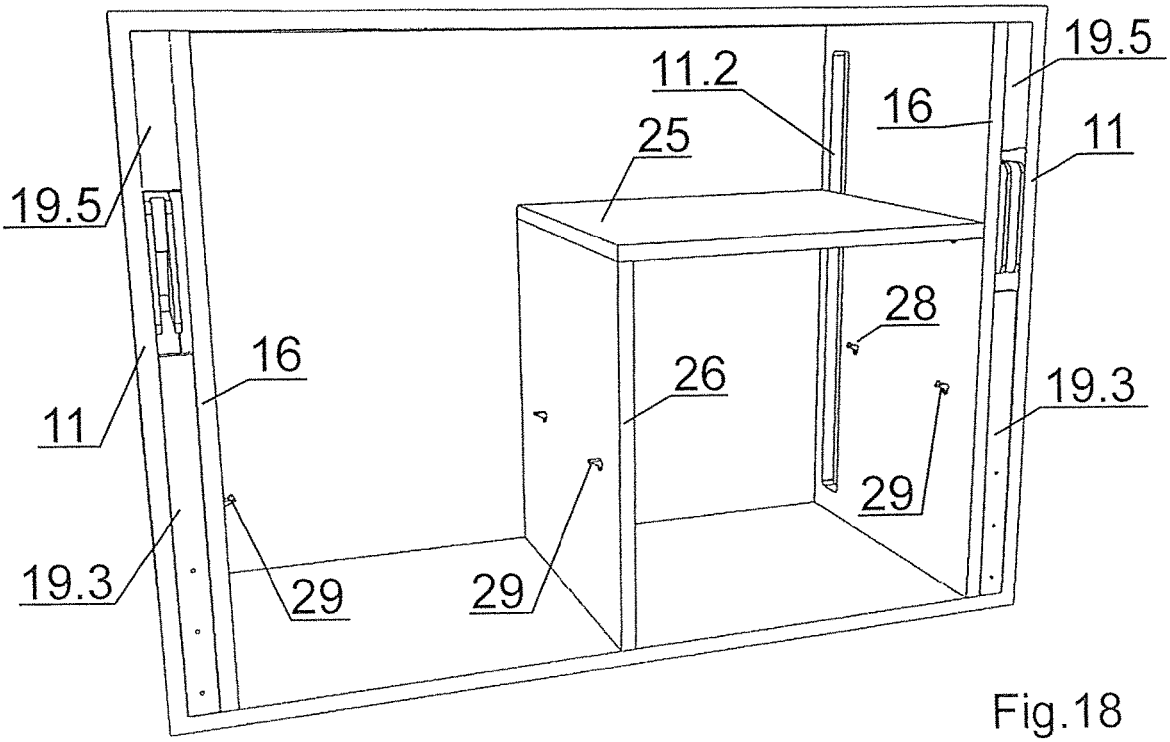
Figure 19:
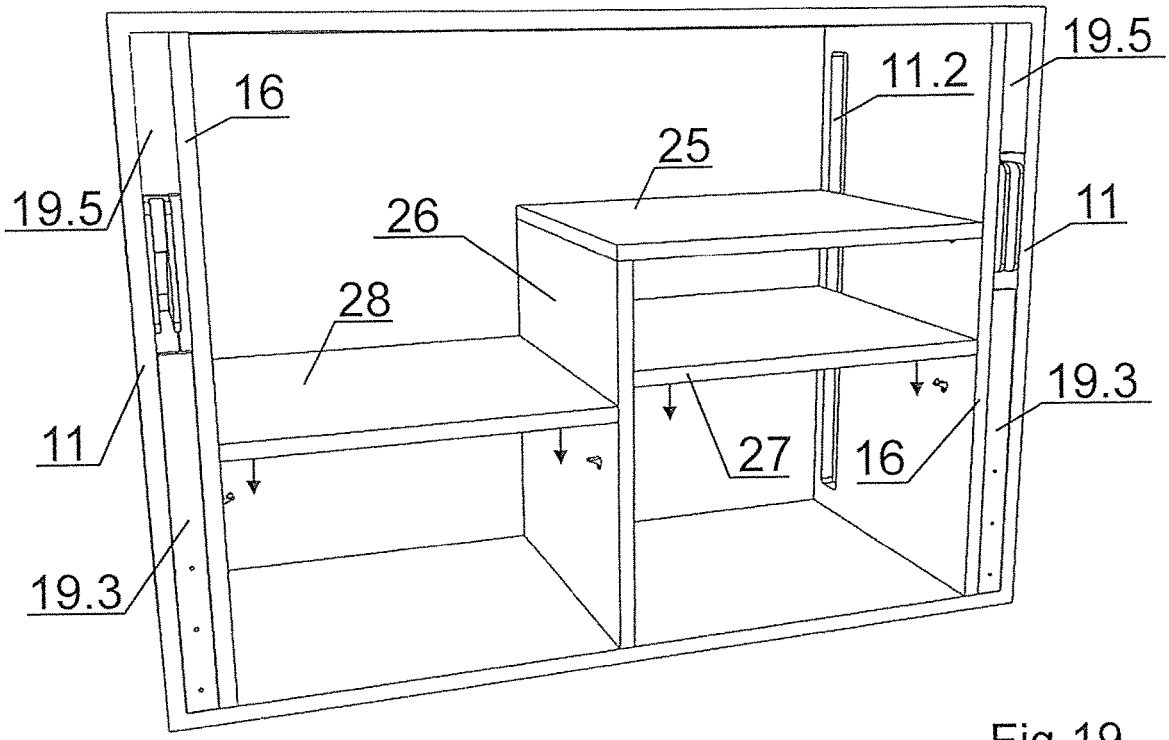
Figure 20:
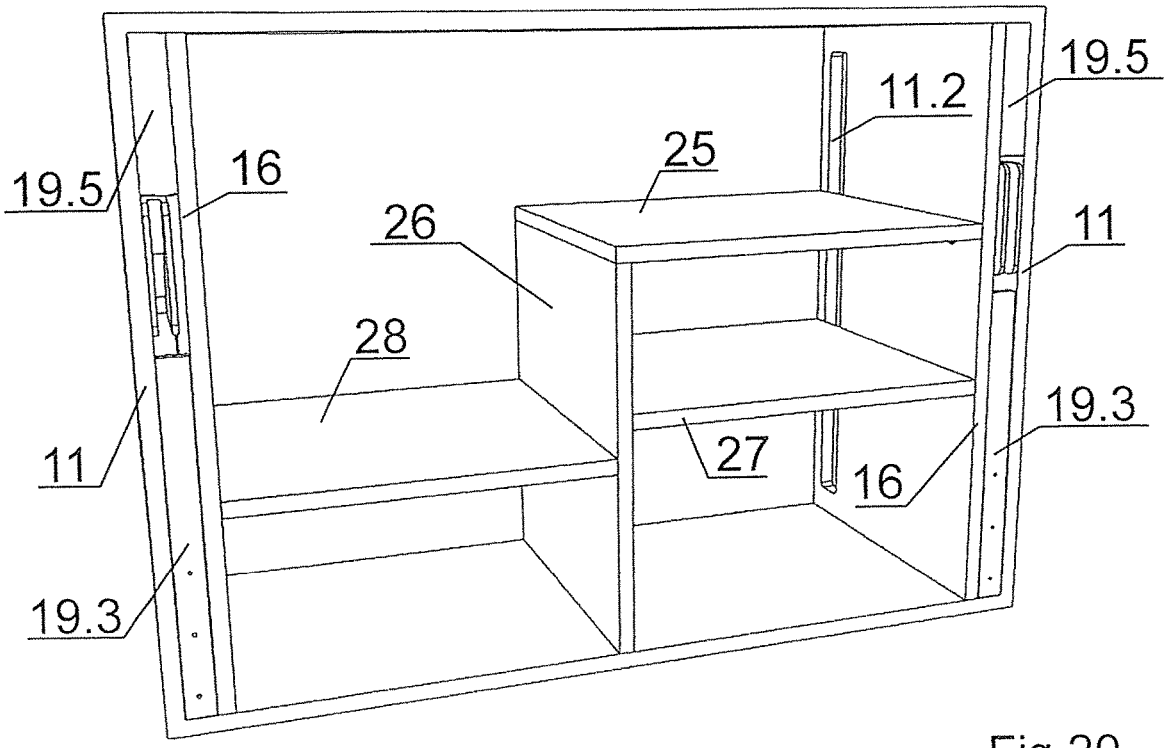

FIG. 4 in perspective shows the wall-mounted cabinet with the flap door open during installation in a kitchen cabinet wall;

FIG. 5 shows the kitchen cabinet wall of FIG. 4 in the closed position of the flap door;

FIG. 6 shows a block-shaped cabinet carcass, similar to FIG. 2, but with different kinds of additional devices in the cabinet boxes for electrification of the wall-mounted cabinet;

FIG. 7 shows a wall-mounted kitchen cabinet with only partial covering of the tilt fittings, and these coverings are not mounted on the side wall;

FIG. 8 shows the wall-mounted kitchen cabinet of FIG. 7, with coverings mounted on the side wall;

FIG. 9 shows the wall-mounted kitchen cabinet with a lower covering, which is not hinged;

FIG. 10 shows the wall-mounted kitchen cabinet of FIG. 9 with a lower covering that can be swung shut;

FIG. 11 shows the tilt fitting swung down and the covering thus swung inward;

FIG. 12 shows the wall-mounted kitchen cabinet of FIG. 11 with the tilt swung down and the covering swung inward in the closed position of the flap door;

FIG. 13 shows the wall-mounted kitchen cabinet with the tilt fitting located in lowered fashion and with a covering located above it in the installation position;

FIG. 14 shows the wall-mounted kitchen cabinet of FIG. 13 with the coverings in the outset position above and below the tilt fitting;

FIG. 15 shows the wall-mounted kitchen cabinet with the lower covering in the outset position and the tilt fitting in the swung-open position;

FIG. 16 shows the tilt fitting covered with a side wall and with the tilt fitting swung open;

FIG. 17 shows the wall-mounted kitchen cabinet with a subdivided inner compartment in the installation position;

FIG. 18 shows the wall-mounted kitchen cabinet of FIG. 17 with the inner compartment permanently built in;

FIG. 19 shows the wall-mounted kitchen cabinet with an expanded inner compartment, still in the installation position; and FIG. 20 shows the wall-mounted kitchen cabinet of FIG. 19 with the permanently built-in inner compartment.

Figure 1:
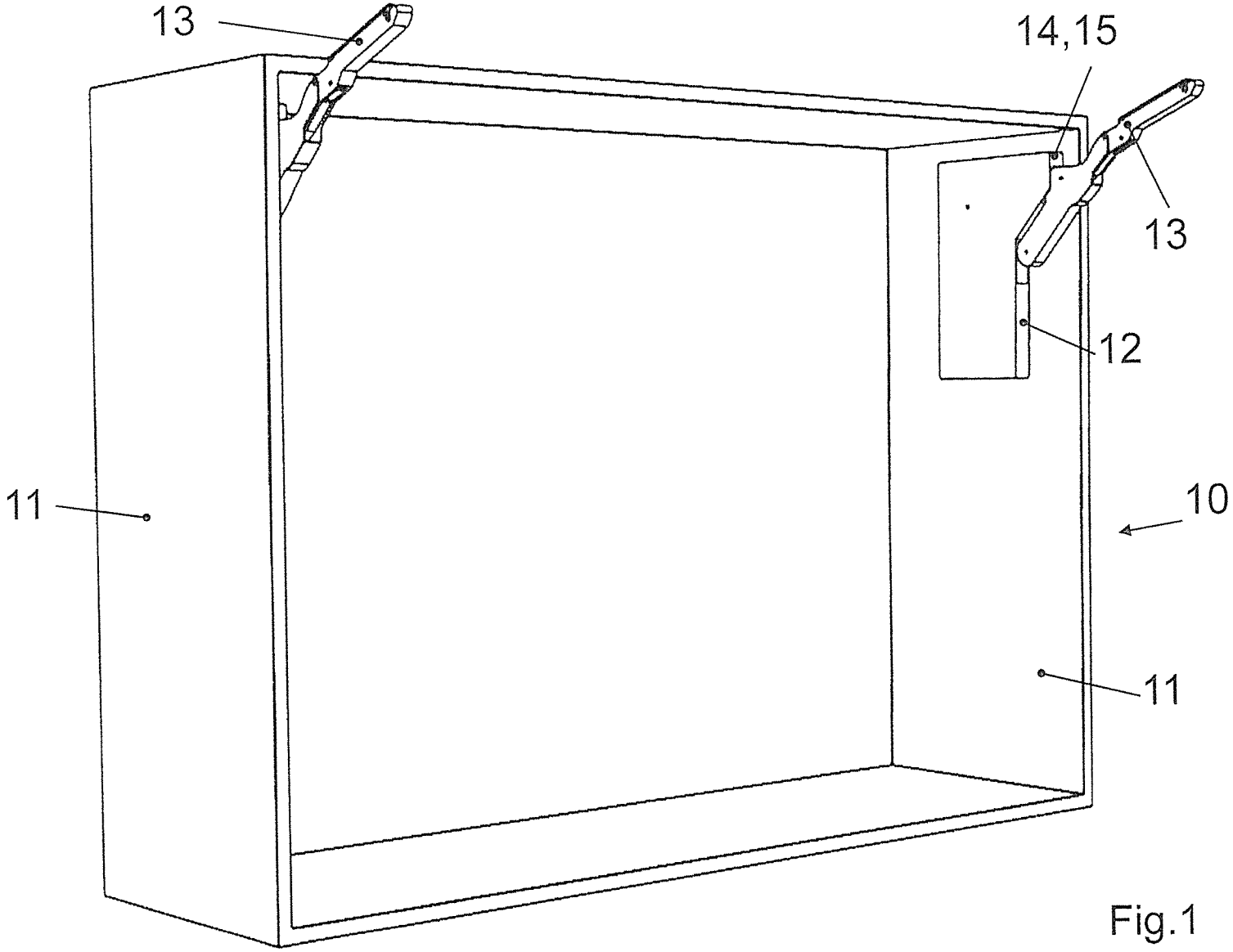

In FIG. 1, a block-shaped cabinet carcass 10 is shown, the front side of which is open. In the upper region, boards 12 are secured to the inner sides of the vertical side walls 11 of the cabinet carcass 10, and on their ends, these boards support tiltably supported tilt fittings 13. In the open position of the tilt fittings 13, as shown, catches 14 of the boards 12 and catches 15 of the tilt fittings 13 determine the open position of the tilt fittings 13.

As FIG. 2 shows, the tilt fittings 13 are covered by vertical inner walls 16. The interstice between the inner walls 16 and the side walls 11 of the cabinet carcass 10 is closed by front coverings 17 and 18. The upper front coverings 17 are lowerable, and when the flap door is open, they protrude slightly from the ends of the inner walls 16 and of the side walls 11 of the cabinet carcass 10. The lower front coverings 18 are fixed and are flush with the ends of the inner walls 16 and of the side walls 11 of the cabinet carcass 10.

Figure 3:
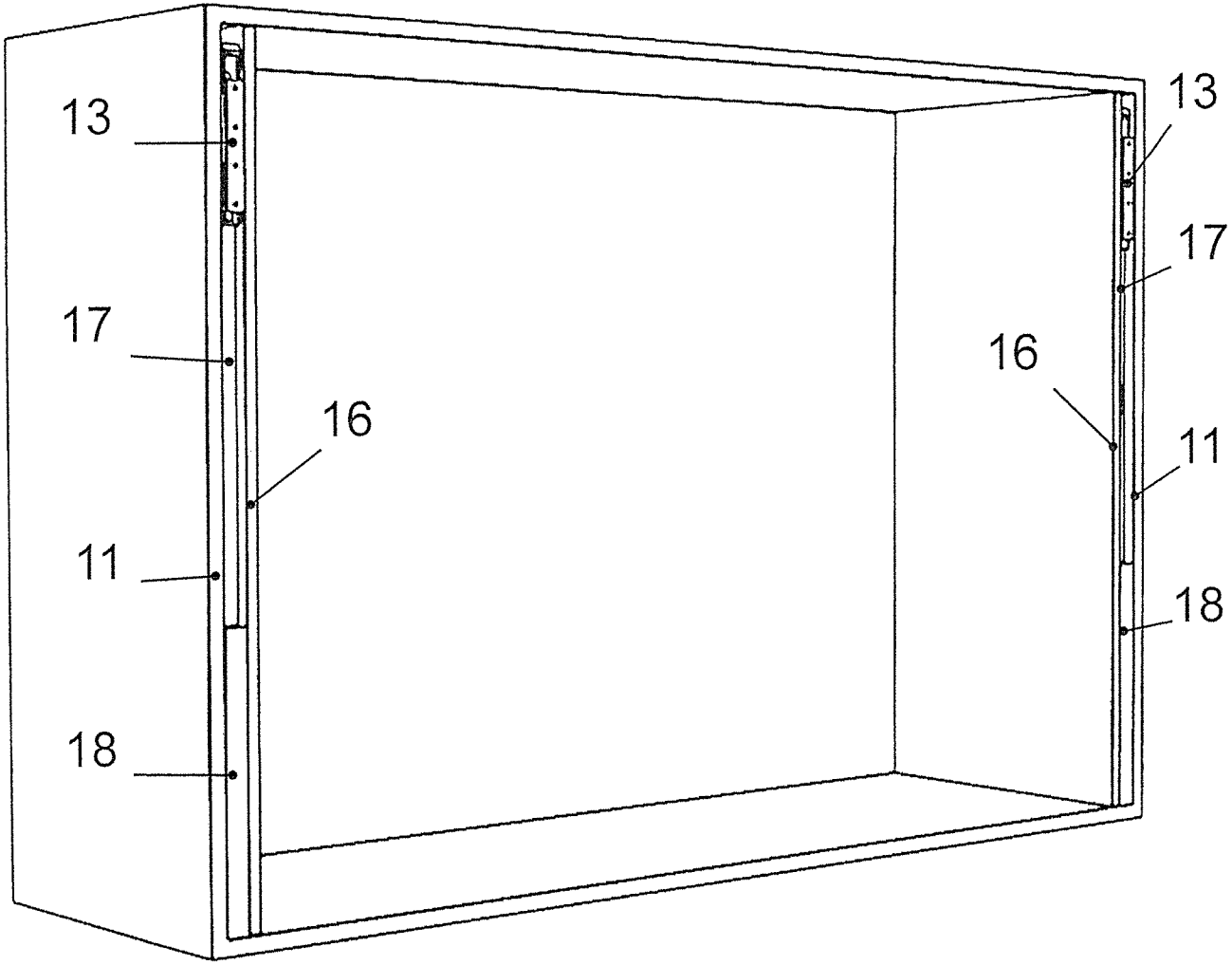
FIG. 3 shows the cabinet carcass of FIG. 2, in which the tilt fittings are in the swung-inward closed position.

Once the flap door is closed, the tilt fittings 13 are swung into the interstices between the inner walls 16 and the side walls 11 of the cabinet carcass 10 in such a way that the fastening surface for the tilt fittings 13 for the inner panel 20 of the flap door closes flush with the ends of the inner walls 16 and of the side walls 11 of the cabinet carcass 10, as FIG. 3 shows.

FIG. 4, in perspective, shows a kitchen cabinet wall with a wall-mounted cabinet of the invention when the flap door is open. The wall-mounted cabinet is built flush into a row of cubicles 40. The flap door comprises an inner panel 20 and an outer panel 21. The inner panel 20 is associated with the lowerable front coverings 17 and extends over the great majority of the upper two cabinet boxes. The outer panel 21 is secured offset downward on the front side of the inner panel 20 and protrudes from the lower side of the inner panel 20 so far that it is flush with the top side of the lowermost cabinet box. The row of cubicles 40 is secured to a wall 70 of the kitchen. Below that row, there is a horizontal work surface 50, which covers a substructure of lower cubicles 60.

As FIG. 5 shows, in the closed position of the flap door the outer panel 21 protrudes from the wall of the row of cubicles 40 by the thickness of the inner panel 20 and ends at the top side of the lowermost cabinet box of the wall-mounted cabinet of the invention. The outer panel 21 of the flap door can thus be easily grasped and opened. FIG. 5 clearly shows that the lowermost cabinet box always remains freely accessible for putting pots and pans, kitchen utensils, and the like in them or storing them there, regardless of whether the flap door is open or closed.

FIG. 6 shows a different exemplary embodiment of a block-shaped cabinet carcass 10 for a wall-mounted cabinet of the invention. The inner sides of the inner walls 16 support lighting elements B below the top wall of the cabinet carcass 10. Above the bottom wall of the cabinet carcass 10, bores for electrification are made in the inner walls 16 and preferably receive electrical outlets. The cords for the lighting elements B and the outlets can be inserted into the interstice between the inner walls 16 and the side walls 11 of the cabinet carcass 10. Subdividing the cabinet carcass 10 into cabinet boxes can be done by sheet-metal elements OB, which are embodied for instance as an organization system.

In the wall-mounted kitchen cabinet without a flap door, shown in FIGS. 7 and 8, it is shown that the tilt fittings 13 are provided on the end with a hinged abutment portion 13.1 and that they are covered only by a board 16, which now extends over a portion of the side wall 11, with which they are flush. Below and above the tilt fitting 13 that can be swung outward, fastening elements 19 and 19.1 are provided, which are connectable directly below the top wall and above the bottom wall of the wall-mounted kitchen cabinet.

As FIGS. 8 and 9 show, the cover elements 19.3 and 19.5 are mounted in hinged fashion on these fastening elements 19 and 19.1; however, in the open position of the flap door, assume a position which is flush with the end of the side wall 11 and of the covering 16 of the tilt fitting 13. The flap door is mounted on the abutment portion 13.1 of the tilt fitting 13 and can be hinged inward onto the fastening portion 19.5 that is hinged on the lower fastening element 19.1. Then the fastening portion 19.5 assumes the position shown in FIG. 12.

Above the covering 16 of the tilt fitting 13, which covering is spaced apart from the top wall of the wall-mounted kitchen cabinet, a fastening portion 19.5 on the fastening element 19 is permanently connected via an intermediate piece 19.4 to the fastening element 19 and always assumes the contact position for the flap door, as can be seen from FIGS. 13 and 14.

FIGS. 15 and 16 show that the tilt fittings 13 can also be covered by a board 16, which extends over only a portion of the side wall 11 of the wall-mounted kitchen cabinet, or which can be covered via a side wall 16 that is parallel to the side wall 11. Both of them, that is, the board 16 and the side wall 16, close flush with the end of the side wall 11.

FIGS. 17 and 18 show how, with additional boards 25 and 26, an inner compartment can be built into the wall-mounted kitchen cabinet. In FIG. 17, the boards 25 and 26 assume the mounting position. In FIG. 18, they are connected permanently to one another and to the covering 16 and the bottom wall of the wall-mounted kitchen cabinet, specifically via pegs 27 and peg slots 28 on the boards 25 and 26 and the bottom wall of the wall-mounted kitchen cabinet. The board 25 then rests on insertion shelves 29, which are inserted into bores 28 in the covering 16.

When the end of the wall-mounted kitchen cabinet is open and the tilt fittings 13 are swung downward, the coverings 19.3 and 19.5 between the side wall 11 and the side wall 16 as a covering always assume the flush contact position for the flap door.

As FIGS. 19 and 20 show, the inner compartment with the boards 25 and 26 can be subdivided by means of storage shelves 27, which are laid on inserts 29. The board 28 creates a further compartment, next to the inner compartment in the wall-mounted kitchen cabinet, that rests only on inserts 29 in the board 26 of the inner compartment that are inserted into corresponding bores 28 in the covering side wall 16.

It is stressed once again as an essential feature that the boards 16 and the covering 16, which is embodied as a side wall parallel to the side wall 11, always completely cover the tilt fittings 13, which can be swung open as long as the flap door is closed, as FIGS. 19 and 20 show. It is important in this respect that the coverings 19.3 and 19.5 are flush with the ends of the boards 16 or side walls 16, which are flush with the end 11 of the wall-mounted kitchen cabinet.

The invention claimed is:

1. A wall-mounted cabinet apparatus, the apparatus comprising:

a block-shaped cabinet body having an open front side, vertical outer side walls, inner side walls, and a horizontal top wall;

at least one cabinet door hingedly coupled to the cabinet body, the cabinet door being flush with the outer side walls and the horizontal top wall of the cabinet body when in a closed position;

a plurality of tilt fittings, the tilt fittings individually coupled to an inner panel of a flap door and mounted on the inner side walls in an upper region of the cabinet body;

wherein the tilt fittings are covered by inner walls;

wherein the flap door is composed of an inner panel and an outer panel, configured to extend across an upper front region of the cabinet body from an outside of the horizontal top wall of the cabinet body to a top side of a lower cabinet box and wherein lowerable front coverings are disposed between the inner side walls and the vertical outer side walls of the cabinet body;

wherein the outer panel of the flap door extends at least across a lower region of the front side of the inner panel and extends as far as the top side of the lower cabinet box of the cabinet body; and wherein fixed front coverings, adjacent to lowerable front coverings, extend to an underside of the lower cabinet box of the cabinet body between the inner side walls and the vertical outer side walls of the cabinet body and are flush with ends of the inner side walls and the vertical outer side walls of the cabinet body.

2. The wall-mounted cabinet of claim 1 wherein the tilt fittings are secured tiltably on the ends of boards, and the flap door is configured to be fixed in an open position by means of catches of the boards and of the tilt fittings, and wherein the tilt fittings are configured to be swung inward and flush with the interstices of the inner walls and of the side walls of the cabinet body when the flap door is in a closed position.

3. The wall-mounted cabinet of claim 1 wherein the lowerable front coverings, are configured to protrude past the ends of the inner side walls and the vertical outer side walls of the cabinet body when the flap door is in an open position, and are configured to be forced into interstices between the inner side walls and the vertical outer side walls of the cabinet body and are flush with them when the flap door is in a closed position.

4. The wall-mounted cabinet of claim 1 further comprising three cabinet boxes disposed vertically one above the other; and wherein the flap door is configured such that it leaves the lower cabinet box in the front side of the cabinet body open and closes the two upper cabinet boxes when the flap door is in the closed position.

5. The wall-mounted cabinet of claim 1 wherein lighting elements are secured to inner sides of the inner walls in an upper region of the cabinet body, and in a lower region of the cabinet body, and wherein elements for electrification are secured, comprising bores for installing plugs; and wherein the subdividing of cabinet boxes in the cabinet body is effected by means of sheet-metal elements configured as organizers.

6. The wall-mounted cabinet of claim 1 wherein the cabinet body is built flush into a row of cubicles, and the outer panel of the flap door is configured to protrude from a front side of the row of cubicles at a spacing of a thickness of the inner panel of the flap door when the flap door is in a closed position.

7. The wall-mounted cabinet of claim 6 wherein a horizontal work surface covers a substructure of lower cubicles, and is spaced apart from and below the row of cubicles; and wherein the tilt fitting has a hinged abutment portion on one end such that the latter is configured to swing into a lower covering position by means of the tilt fitting.

8. The wall-mounted cabinet of claim 7 wherein an upper covering is located above the tilt fitting and spaced apart from the horizontal top wall of the wall-mounted cabinet and is permanently set in a contact position of a kitchen door.

9. The wall-mounted cabinet of claim 8 wherein an inner compartment of the wall-mounted cabinet is configured to be put together by means of pegs and peg slots on boards of an inner compartment and bottom panel of the wall-mounted cabinet; and wherein the inner compartment of the wall-mounted cabinet is configured to be subdivided by laying additional boards on shelves that have been inserted therein.

10. The wall-mounted cabinet of claim 9 wherein the tilt fittings are covered by boards which extend over the side wall of the wall-mounted cabinet.

* * * * *